US005808548A

United States Patent [19]

Sasagawa et al.

[11] Patent Number: 5,808,548

[45] Date of Patent: Sep. 15, 1998

[54] ALARM-EQUIPPED ELECTRONIC ARTICLE SURVEILLANCE SYSTEM

[75] Inventors: Shinichi Sasagawa; Seishi Namioka; Nobuyuki Ichimiya; Shin Kinouchi, all of Miyagi-ken, Japan

[73] Assignee: Alps Electric Co., Ltd., Tokyo, Japan

[21] Appl. No.: 627,486

[22] Filed: Apr. 4, 1996

[30] Foreign Application Priority Data

Apr. 10, 1995 [JP] Japan ..... 7-084047

[51] Int. Cl.[6] ..... G08B 13/14

[52] U.S. Cl. ..... 340/571; 340/572

[58] Field of Search ..... 340/571, 572

[56] References Cited

U.S. PATENT DOCUMENTS

| | | | |
|---|---|---|---|
| 4,573,042 | 2/1986 | Boyd et al. | 340/539 |
| 5,187,354 | 2/1993 | Bengtsson | 340/572 |
| 5,245,317 | 9/1993 | Chidley et al. | 340/572 |
| 5,589,819 | 12/1996 | Takeda | 340/572 |

*Primary Examiner*—Edward Lefkowitz

*Attorney, Agent, or Firm*—Brinks Hofer Gilson & Lione

[57] ABSTRACT

An alarm-equipped electronic article surveillance system which is easy to handle, which provides against the triggering of false alarm, and which reliably surveys articles of interest against theft. The system comprises a signal transmitter device located close to the gates of access to an area of interest, and a plurality of tags each attached to an article of merchandise under surveillance. The signal transmitter device includes a signal generator for generating a modulated signal by modulating a carrier frequency signal with a modulation signal, a signal transmitter for transmitting the modulated signal, and a transmitting antenna. The plurality of tags each include a receiving antenna, a signal receiver for selectively receiving the modulated signal, a frequency selector for selecting the modulation signal out of the modulated signal, an alarm generator operable for generating an output indicative of an alarm condition, and an alarm negator for negating the operation of the alarm generator.

23 Claims, 4 Drawing Sheets

ALARM-EQUIPPED ELECTRONIC ARTICLE SURVEILLANCE SYSTEM

BACKGROUND OF THE INVENTION

1. Field of the Invention

The present invention relates to an alarm-equipped electronic article surveillance system (hereinafter referred to as an E. A. S. System) and, more particularly, to an alarm-equipped E. A. S. System constituted by signal transmitter devices located close to the gates of access to an area of interest and by a signal receiver and an alarm device incorporated in each of tags attached to articles of merchandise being surveyed.

2. Description of the Related Art

There already exists the wired type of E. A. S. System using tags attached to articles of merchandise under surveillance. Cables extending from these tags are grouped into bundles each made up of a predetermined number or cables. Each bundle is connected to a repeater. A plurality of such repeaters are connected through as many cables to the host apparatus of the system.

The wired E. A. S. System works as follows: as long as each tag is attached to an article of merchandise under surveillance, the alarm generator in the host apparatus remains inactive. If any of the tags is removed without proper procedures from the article of merchandise to which it was attached, an abrupt change in the internal resistance of the tag is detected by the host apparatus. This activates an alarm generator furnished in the host apparatus, thereby warning employees that something unusual has occurred to a particular article of merchandise being surveyed.

Although the above type of wired E. A. S. System serves well as an E. A. S. System, it has a number of disadvantages. First, a connection cable must be extended from each of the tags attached to the articles of merchandise to be surveyed. When these cables are connected to repeaters, more cables are needed for connection from the repeaters to the host apparatus of the system. Such proceedings pose a difficult problem of cable handling to employees. In terms of appearance, the many cables running throughout the shop tend to make the articles of merchandise on display less attractive.

A wireless E. A. S. System has been proposed to solve the problem of the connection cables trailing all over the shop. This system involves having signal transmitters (or receivers) installed within the area of interest and a signal receiver (or transmitter) incorporated in each of the tags attached to articles of merchandise being surveyed.

The conventional wireless E. A. S. System, however, also has a number of deficiencies. Illustratively, tags attached to articles of merchandise under surveillance sometimes generate false alarm by responding erroneously to external noises such as those coming from CRTs and inverter circuits built into fluorescent lamps. To avoid the triggering of false alarm requires locating the tags away from the potential electrical noise sources.

Another deficiency of the conventional wireless E. A. S. System is associated with the procedure of negating the alarm. When an audible tone being produced from a tag is to be stopped or when the tone is to be forestalled before its generation, a specially prepared rod or the like tool is typically inserted into a hole at a particular location of the tag housing in order to activate an alarm negating switch inside. The trouble is that the alarm negating procedure is a tiresome chore shouldered by employees. Furthermore, the alarm of the tag can be negated maliciously by some unscrupulous shoppers pushing a wire or like object into the hole of the tag housing to activate the alarm negating switch.

SUMMARY OF THE INVENTION

It is therefore an object of the present invention to overcome the above-described drawbacks and disadvantages of the prior art and to provide an alarm-equipped E. A. S. System which is easy to handle, which provides against the triggering of false alarm, and which surveys reliably articles of interest against theft.

It is another object of the present invention to provide an alarm-equipped E. A. S. System which is easy to operate in negating the generation of an alarm from each tag attached to an article of merchandise, whereby the alarm of any tag is reliably deactivated only when so desired.

In carrying out the invention and according to one aspect thereof, there is provided an alarm-equipped E. A. S. System comprising a signal transmitter device located close to the gates of access to an area of interest, and a plurality of tags each attached to an article of merchandise under surveillance. The signal transmitter device includes a signal generator for generating a modulated signal by modulating a carrier frequency signal with a modulation signal, a signal transmitter for transmitting the modulated signal, and a transmitting antenna. The plurality of tags each include a receiving antenna, a signal receiver for selectively receiving the modulated signal, a frequency selector for selecting the modulation signal out of the modulated signal, an alarm generator operable for generating an output indicative of an alarm condition, and an alarm negator for negating the operation of the alarm generator.

In a first preferred variation of the invention, the alarm negator in each of the tags comprises a control signal detecting tip and an AND circuit whose output is connected to the alarm generator. The control signal detecting tip receives a control signal having the same frequency as that of the modulation signal detected by a tag control unit. The AND circuit acts to have the operation of the alarms generator negated if the control signal received by the control signal detecting tip is input to the AND circuit concurrently with the control signal received via the frequency selector by the control signal detecting tip.

In a second preferred variation of the invention, the alarm negator in each of the tags comprises a second frequency selector for selecting a control signal having a frequency different from that of the modulation signal. The input and output of the second frequency selector are connected to the signal receiver and the alarm generator, respectively. The alarm negator negates the operation of the alarm generator if the control signal transmitted from a tag control unit is first received by the tag in question, the received control signal is then selected by the second frequency selector via the signal receiver, and the selected control signal is thereafter input to the alarm generator.

The alarm-equipped E. A. S. System embodied as outlined above works roughly as follows: the signal transmitter device located near the gates of access to the area of interest keeps transmitting the modulated signal with an intensity high enough to turn the vicinity of the gates of access into a service area of that signal while articles of merchandise are being surveyed. In this state, the numerous tags attached to the articles of merchandise, as long as the articles are located where they should be, are outside the service area of the modulated signal coming from the signal transmitter device.

The tags thus remain unresponsive to the modulated signal and the alarm generators inside stay inactive. When at least one article of merchandise under surveillance is being brought out of the area of interest without authorization through the gates of access, the tag attached to the article temporarily enters the service area of the modulated signal, thus causing the alarm generator to generate an audible alarm tone in response to the signal as long as the tag is in the service area. Employees at the shop are thus warned of a possible theft taking place.

The above embodiment of the invention is easy to handle because no tag-connecting cable needs to be installed or hooked up. Only two kinds of installation work -are needed: setting up the signal transmitter device close to the gates of access to the area of interest, and attaching tags to articles of merchandise to be surveyed. These tags seldom trigger false alarm because their alarm generators are activated only when relocated close enough to the gates of access to receive the modulated signal emitted by the signal transmitter device in the vicinity. The articles of merchandise are thus surveyed securely and free of false alarm.

The first preferred variation of the invention includes the tag control unit used exclusively to negate the alarm generator within each tag. To negate the generation of an alarm tone from a tag, an employee in charge brings the tag control unit close to, or in contact with, a predetermined position of the tag in question. At this point, the alarm generator inside the tag is negated only if the alarm negator inside (i.e., the AND circuit) generates an appropriate output upon concurrent receipt of two inputs: the control signal coming from the tag control unit and received by the control signal detecting tip, and the control signal also coming from the tag control unit but received via the frequency selector by the signal control detecting tip.

The second preferred variation of the invention also includes the tag control unit used exclusively to negate the alarm generator within each tag. To negate the generation of an alarm tone from a tags, an employee in charge brings the tag control unit close to the tag in question. At this point, the alarm generator inside the tag is negated only if the alarm negator inside (i.e., the second frequency selector) generates an appropriate output upon selecting the control signal which is emitted by the tag control unit and forwarded through the signal receiver of the tag.

As outlined, the first and second variations of the invention allow anyone authorized simply to bring the dedicated tag control unit close to or in contact with the tag in order to negate the generation of an alarm tone therefrom. Handling of the tag control unit poses little problem to employees because of its ease of use. Furthermore, since the dedicated tag control unit alone is capable of negating the alarm generating function of tags, any tag can be negated reliably only when and where necessary.

Other objects and further features of the invention will be apparent from the following detailed description when read in conjunction with the accompanying drawings.

DESCRIPTION OF THE PREFERRED EMBODIMENTS

Figure 1A:
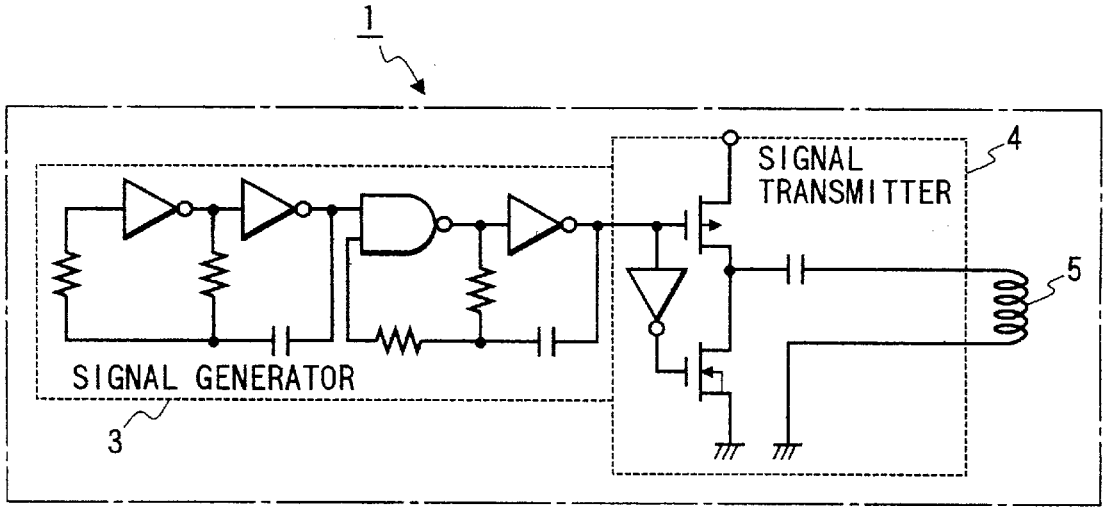
FIGS. 1A and 1B are block diagrams outlining an alarm-equipped E. A. S. System practiced as an embodiment of the invention.
Figure 1B:
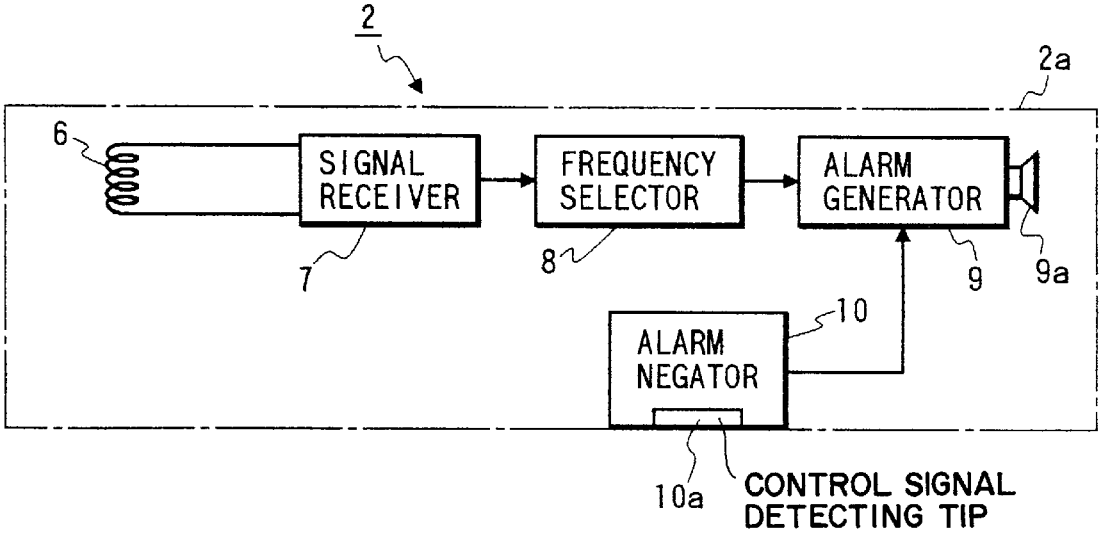

FIGS. 1A and 1B are block diagrams outlining an alarm-equipped E. A. S. System embodying the invention. Specifically, FIG. 1A depicts the constitution of a signal transmitter device 1, and FIG. 1B shows that of a tag 2.

As illustrated in FIG. 1A, the signal transmitter device 1 comprises a signal generator 3, a signal transmitter 4 and a transmitting antenna 5. The signal generator 3 generates a modulated signal through amplitude modulation (AM) or intermittent modulation of a carrier signal having a frequency fc by use of a modulation signal having a frequency fs (fc>fs). The signal transmitter 4 amplifies the modulated signal from the signal generator 3 and feeds the amplified signal to the transmitting antenna 5. The transmitting antenna 5 broadcasts the modulated signal on radio waves into the air.

As shown in FIG. 1B, the tag 2 comprises: a receiving antenna 6 that receives the signal radio waves emitted into the air; a signal receiver 7 that receives the modulated signal from the signal transmitter device 1 via the receiving antenna 6, amplifies the received demodulated signal appropriately before demodulation, and outputs a demodulated signal containing the modulation signal having the frequency fs; a frequency selector 8 that selectively outputs only the modulation signal having the frequency fs out of the demodulated signal coming from the signal receiver 7; an alarm generator 9 that causes an alarm 9*a* to generate an audible tone in response to the modulation signal having the frequency fs from the frequency selector 8; and an alarm negator 10 that negates the alarm generating operation of the alarm generator 9 only if a control signal detecting tip 10*a* is fed with an appropriate control signal. In this setup, the control signal detecting tip 10*a* is disposed at a predetermined location on a housing 2*a* of the tag 2.

Where the alarm-equipped E. A. S. System of the invention is established effectively to survey numerous articles of merchandise on display inside the shop, the signal transmitter device 1 is installed close to the gates of access to the shop floor and as inconspicuously as possible. Each tag 2 is attached to each article of merchandise in a secure manner that resists casual detachment.

The inventive alarm-equipped E. A. S. System as embodied above works as follows:

The signal transmitter device 1 is first installed close to the gates of access to an area of interest, e.g., near the entrance to the shop. Installation of the signal transmitter device 1 is arranged so that radio waves of the modulated signal being broadcast will concentrate on the vicinity of the gates of access. At the same time, the tags 2 are attached to all articles of merchandise to be surveyed. A check is made to see if the tags 2, as attached to articles of merchandise on display, do not detect the modulated signal radio waves from the signal transmitter device 1. If the result of the check is satisfactory, surveillance operation is started.

In the setup above, as long as tag-equipped articles of merchandise remain where they are or are relocated by shoppers inside the shop but not close to the gates of access, the tags attached to the articles do not enter the service area of the modulated signal radio waves emitted by the signal transmitter device 1. Because the signal receiver 7 in each of these tags does not receive the radio waves, the signal receiver 7 does not effect its demodulated output. That in turns keeps the frequency selector 8 from generating the modulation signal having the frequency fs. As a result, the alarm generator 9 in each tag remains inactive.

By contrast, if a shopper tries to bring a tag-equipped article of merchandise out of the shop without proper authorization, the tag 2 attach to the article enters the service area of the modulated signal radio waves transmitted by the signal transmitter device 1. The receiving antenna 6 of the tag 2 then detects the radio waves, and the signal receiver 7 receives the radio waves through the antenna 6. The signal receiver 7 in the tag 2 then generates a demodulated output causing the frequency selector 8 to output the modulation signal having the frequency fs. When supplied with the modulation signal, the alarm generator 9 causes the alarm 9*a* to generate an audible tone indicative of an alarm condition.

With the above embodiment in operation, when the tag 2 attached to an article of merchandise is about to pass along with a shopper through the entrance of the shop, the tag 2 automatically generates an alarm tone by sensing the modulated signal radio waves transmitted from the signal transmitter device 1. The alarm tone warns shop employees that an article of merchandise is being brought out of the shop without authorization.

After the alarm generator 9 has acted to get the alarm 9*a* to generate an audible tone, the alarm is negated by use of a tag control unit. An output signal from the tag control unit activates the alarm negator 10 which in turn negates the activated alarm. More about the negating operation will be discussed later.

Figure 2A:
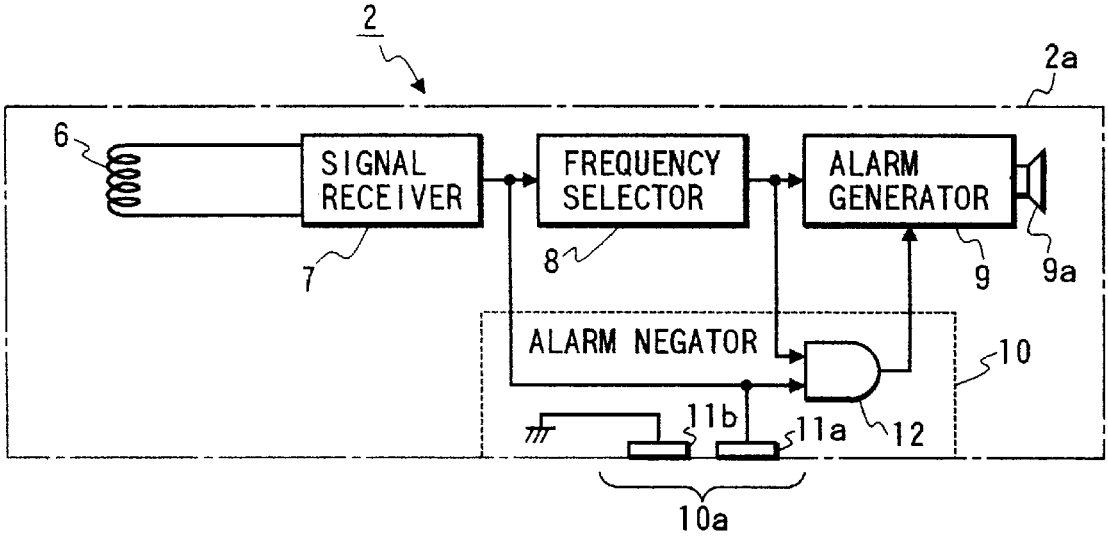
FIGS. 2A and 2B are block diagrams showing typical constitutions of an alarm negator and a tag control unit used in combination therewith in the embodiment of FIG. 1.
Figure 2B:
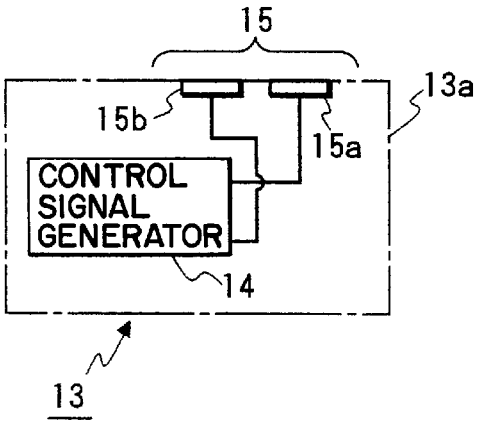

FIGS. 2A and 2B are block diagrams showing typical constitutions of an alarm negator and a tag control unit used in combination therewith in the embodiment of FIG. 1. Specifically, FIG. 2A shows the constitution of a tag and FIG. 2B illustrates that of a tag control unit.

As shown in FIG. 2A, the alarm negator 10 comprises the control signal detecting tip 10*a* including a pair of connecting terminals 11*a* and 11*b* attached to the housing 2*a* of the tag 2, and an AND gate circuit 12. One connecting terminal 11*a* is connected to one of the two inputs of the AND gate circuit 12 as well as to the input of the frequency selector 8. The other connecting terminal 11*b* is connected to ground. The other input of the AND gate circuit 12 is connected to the output of the frequency selector 8. The output of the AND gate circuit 12 is connected to the alarm generator 9.

As illustrated in FIG. 2B, the tag control unit 13 comprises a control signal generating tip 15 and a control signal generator 14. The control signal generating tip 15, attached to the housing 13*a* of the tag control unit 13, includes a pair of connecting terminals 15*a* and 15*b* which may be connected to the two connecting terminals 11*a* and 11*b*. The control signal generator 14 generates a control signal having the same frequency fs as that of the modulation signal.

Of the parts in FIGS. 2A and 2B, those also shown in FIG. 1B are designated by like reference numerals.

What follows is a description of how the alarm negator 10 and tag control unit 13 of the above constitution operate. It is assumed here that the tag 2 has received the modulated signal radio waves transmitted from the signal transmitter device 1, with the alarm generator 9 generating an audible tone indicative of an alarm condition.

Initially, the control signal generating tip 15 of the tag control unit 13 is brought close to the control signal detecting tip 10 of the tag 2. The paired connecting terminals 15*a* and 15*b* of the control signal generating tip 15 are coupled to the two connecting terminals 11*a* and 11*b* of the control signal detecting tip 10*a*. At this point, the tag control unit 13 has its control signal generator 14 generating the control signal having the frequency fs. The generated control signal is transmitted via the paired connecting terminals 15*a* and 15*b* of the tag control unit 13 to the two connecting terminals 11*a* and 11*b* of the tag 2. Past the terminals 11*a* and 11*b*, the control signal is supplied to tie alarm negator 10. Having reached the alarm negator 10, the control signal is then forwarded direct to one of the two inputs of the AND gate circuit 12. At the same time, the control signal is fed to the frequency selector 8. The frequency selector 8 lets the received control signal pass through because the signal has the same frequency fs as that of the modulation signal. Past the frequency selector 8, the control signal is supplied to the other input of the AND gate circuit 12. Given the same control signal to its two inputs, the AND gate circuit 12 generates the AND output which negates the alarm generating operation of the alarm generator 9.

In the above example, the alarm generating operation of the alarm generator 9 in the tag 2 is negated by simply connecting the tag control unit 13 to the tag as described. The simple negating procedure poses little extra burden on the part of employees. Since the dedicated tag control unit 13 is required in order to negate the activated state of the alarm generator 9 in any tag 2, no person other than authorized employees can negate the alarm of the tag at will. With authorized personnel alone having access to the tag control unit 13, the tag alarm is negated unfailingly only when necessary.

Figure 3A:
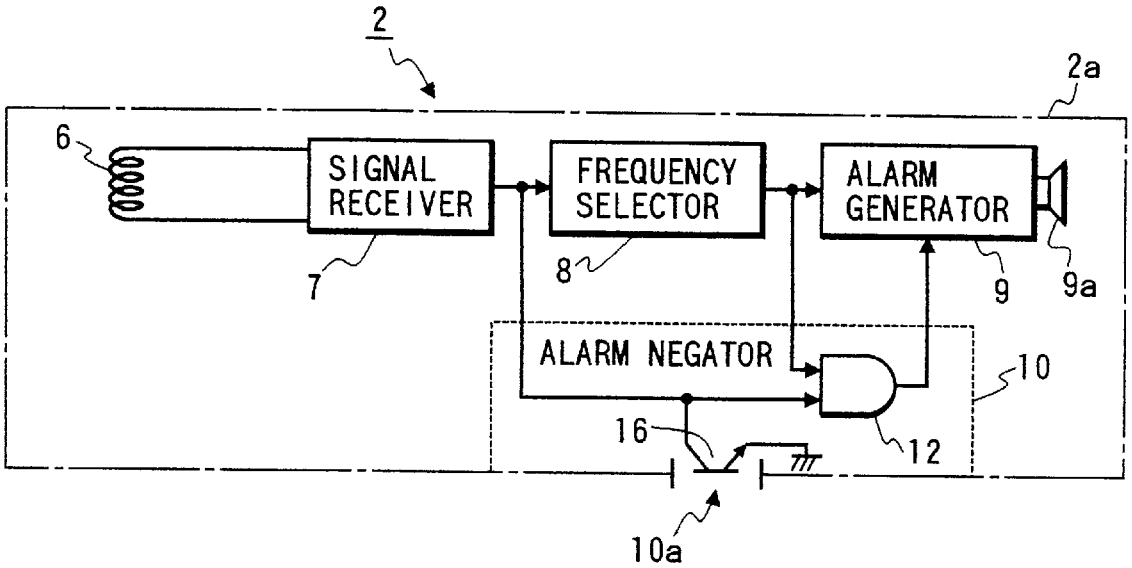
FIGS. 3A and 3B are block diagrams depicting alternative constitutions of an alarm negator and a tag control unit used in combination therewith in the embodiment of FIG. 1.
Figure 3B:
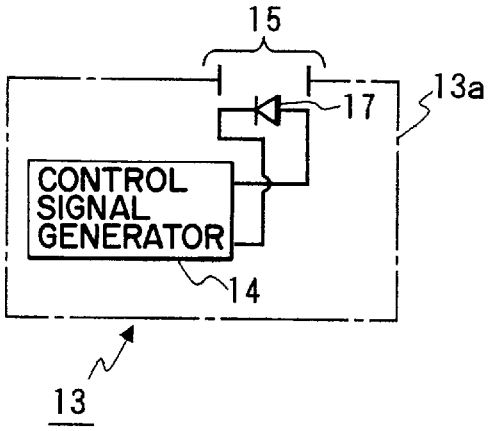

FIGS. 3A and 3B are block diagrams depicting alternative constitutions of an alarm negator and a tag control unit used in combination therewith in the embodiment of FIG. 1. Specifically, FIG. 3A shows the constitution of a tag, and FIG. 3B illustrates that of a tag control unit.

As shown in FIG. 3A, the alarm negator 10 comprises a control signal detecting tip 10*a* including a photo-transistor 16 disposed inside an opening of the housing 2*a* of the tag 2, and an AND gate circuit 12. The collector of the photo-transistor 16 is connected to one of the two inputs of the AND gate circuit 12 as well as to the input of the frequency selector 8. The emitter of the photo-transistor 16 is connected to ground. In this example, too, the other input of the AND gate circuit 12 is connected to the output of the frequency selector 8, and the output of the AND gate circuit 12 is connected to the alarm generator 9.

As depicted in FIG. 3B, the tag control circuit 13 comprises a control signal generating tip 15 and a control signal generator 14. The control signal generating tip 15 is composed of a light-emitting diode (LED) 17 disposed in an opening of the housing 13*a* of the tag control unit 13. The control signal generator 14 generates a control signal having the same frequency fs as that of the modulation signal.

Of the parts in FIGS. 3A and 3B, those also shown in FIG. 1B are designated by like reference numerals.

Below is a description of how the alarm negator 10 and tag control unit 13 of the above constitution operate. It is also assumed here that the tag 2 has received the modulated signal radio waves transmitted from the signal transmitter device 1, with the alarm generator 9 generating an audible tone indicative of an alarm condition.

The control signal generating tip 15 of the tag control unit 13 is first brought close to the control signal detecting tip 10*a* of the tag 2. At this point, the tag control unit 13 has its control signal generator 14 generating the control signal having the frequency fs. The generated control signal is supplied to the light-emitting diode 17 for conversion to an optical control signal. After conversion, the optical control signal is transmitted through the opening of the tag control unit 13 to the photo-transistor 16 of the tag 2. In the alarm negator 10 of the tag 2, the photo-transistor 16 converts the received optical control signal into a control signal. The converted control signal is fed direct to one of the two inputs of the AND gate circuit 12. At the same time, the control signal is supplied to the frequency selector 8. Here, the frequency selector 8 also lets the received control signal pass through because the signal has the same frequency fs as that of the modulation signal. Past the frequency selector 8, the control signal is supplied to the other input of the AND gate circuit 12. Given the same control signal to its two inputs, the AND gate circuit 12 generates the AND output which negates the alarm generating operation of the alarm generator 9.

In this example, the alarm generating operation of the alarm generator 9 in the tag 2 is negated by simply bringing the tag control unit 13 close to the tag as described. As in the previous example, the simple negating procedure poses little extra burden on the part of employees. Since the dedicated tag control unit 13 is required likewise in order to negate the activated state of the alarm generator 9 in any tag 2, no person other than authorized employees can negate the alarm of the tag at will. With authorized personnel alone having access to the tag control unit 13, the tag alarm is negated unfailingly only when necessary.

Figure 4A:
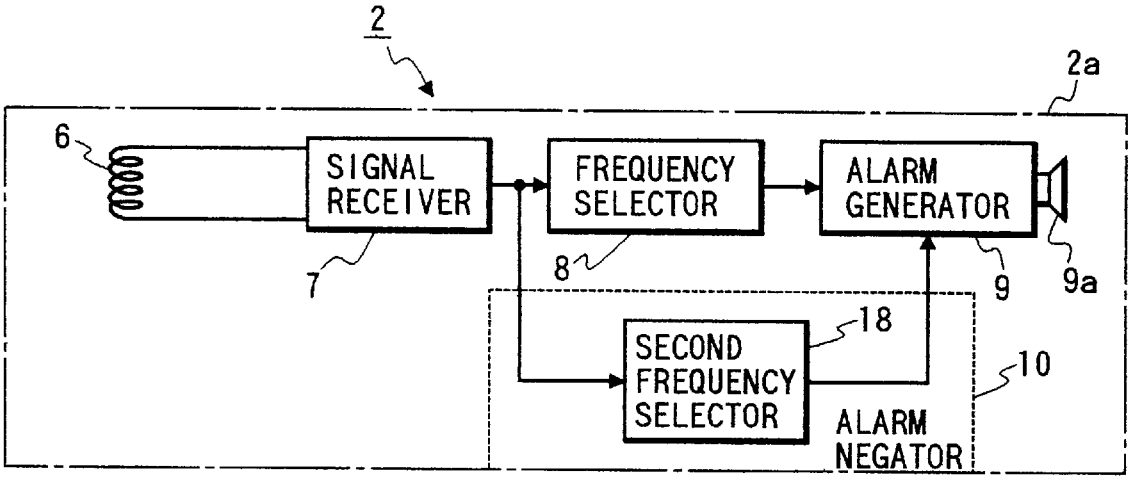
FIGS. 4A and 4B are block diagrams indicating further alternative constitutions of an alarm negator and a tag control unit used in combination therewith in the embodiment of FIG. 1.
Figure 4B:
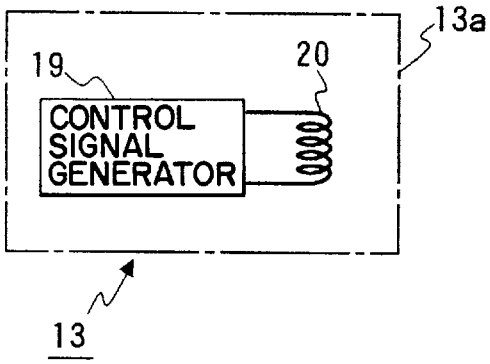

FIGS. 4A and 4B are block diagrams indicating further alternative constitutions of an alarm negator and a tag control unit used in combination therewith in the embodiment of FIG. 1. Specifically, FIG. 4A depicts the constitution of a tag, and FIG. 4B shows that of a tag control unit.

As depicted in FIG. 4A, the alarm negator 10 includes a second frequency selector 18 for selectively outputting a frequency $fS_2$ different from the frequency fs of the modulation signal. The input of the second frequency selector 18 is also connected to the input of the frequency selector 8. The output of the second frequency selector 18 is connected to the alarm generator 9.

As shown in FIG. 4B, the tag control unit 13 comprises a control signal generator 19 and a transmitting antenna 20. The control signal generator 19 generates a control signal having the frequency $fpc_2$ different from the frequency fs of the modulation signal. The transmitting antenna 20 broadcasts into the air the control signal from the control signal generator 19 in the form of radio waves.

Of the parts in FIGS. 4A and 4B, those also shown in FIG. 1B are designated by like reference numerals.

What follows is a description of how the alarm negator 10 and tag control unit 13 of the above constitution operate. It is also assumed here that the tag 2 has received the modulated signal radio waves transmitted from the signal transmitter device 1, with the alarm generator 9 generating an audible tone indicative of an alarm condition.

The transmitting antenna 20 of the tag control unit 13 is first brought close to the receiving antenna 6 of the tag. At this point, the tag control unit 13 has its control signal generator 19 generating the control signal having the frequency $fs_2$. The generated control signal is broadcast into the air from the transmitting antenna 20 as control signal radio waves. The broadcast control signal is received by the signal receiver 7 of the tag 2 via the receiving antenna 6. The control signal thus received is fed to the second frequency selector 18. The second frequency selector 18 lets the received control signal be output unmodified because the signal has the frequency $fs_2$. The output of the second frequency selector 18 causes the alarm generating operation of the alarm generator 9 to be negated.

In this example, too, the alarm generating operation of the alarm generator 9 in the tag 2 is negated by simply bringing the tag control unit 13 close to the tag as described. As in the earlier examples, the simple negating procedure poses little extra burden on employees. Since the dedicated tag control unit 13 is required likewise in order to negate the activated state of the alarm generator 9 in any tag 2, no person other than authorized employees can negate the alarm of the tag at will. With authorized personnel alone having access to the tag control unit 13, the tag alarm is negated unfailingly only when necessary.

Described below are some other combination modifications of the alarm negator 10 and tag control unit 13 being contemplated.

In a first combination modification, the tag control unit 13 comprises a heater driver and a heater disposed in the housing 13*a* of the unit 13. The alarm negator 10 includes a heat exchanger plate disposed where appropriate on the housing 2*a* of the tag 2, a heat sensing element such as a thermistor arranged for contact with the heat exchanger plate, and a resistance detecting circuit for detecting the resistance of the heat sensing element. In operation, an activated heater of the tag control unit 13 is brought into contact with the heat exchanger plate of the tag 2. The heat transferred at this point from the heater to the heat exchanger plate is applied to the heat sensing element. When thus heated, the heat sensing element has its resistance value abruptly changed. The change in resistance causes the resistance detecting circuit to effect its output negating the alarm generating operation of the alarm generator 9.

In a second combination modification, the tag control unit 13 has a plurality of magnets. The alarm negator 10 comprises a plurality of magnetism sensing elements such as Hall ICs, and a pattern comparator. The plurality of magnets of the tag control unit 13 are brought close to the plurality of magnetism sensing elements of the tag 2. At this point, the magnetism sensing elements sense the orientation of the S and N poles of the individual magnets and generate a pattern on the basis of the detected polar orientation. The pattern comparator compares the pattern thus generated with a predetermined pattern. If the two patterns match, the pattern comparator effects its output causing the alarm generating operation of the alarm generator 9 to be negated.

In a third combination modification, the tag control unit 13 has a strong magnet. The alarm negator 10 comprises a magnetism detecting circuit and a magnetism sensing element such as a Hall IC whose magnetic sensitivity is considerably reduced through magnetic shields or by similar means. In operation, the strong magnet of the tag control unit 13 is brought close to the low-sensitivity magnetic sensing element of the tag 2. When the magnetism sensing element senses the strong magnet, the magnetism detecting circuit generates a detection output negating the alarm generating operation of the alarm generator 9.

In any one of the first through the third combination modifications of the alarm negator 10 and tag control unit 13, simply bringing the tag control unit 13 close to the tag 2 negates the alarm generating operation of the alarm generator 9 in the tag. The negating procedure is easy to carry out and poses little burden on employees. Since the dedicated tag control unit 13 is required in order to negate the active state of the alarm generator 9 in the tag 2, no person other than authorized employees can negate the tag alarm unscrupulously. This makes it possible to negate the tag alarm unfailingly only when necessary. As described, the preferred embodiment of the invention is easy to handle because no tag-connecting cable needs to be installed or hooked up. Only two kinds of installation work are needed: setting up the signal transmitter device 1 close to the gates of access to the area of interest, and attaching tags 2 to articles of merchandise to be surveyed. The tags 2 seldom trigger false alarm because their alarm generators are activated only when relocated close enough to the gates of access to receive the modulated signal emitted by the signal transmitter device 1 in the vicinity. The articles of merchandise are thus surveyed securely and with little incidence of false alarm.

Some variations of the invention allow anyone authorized simply to bring the dedicated tag control unit 13 close to or in contact with the tag 3 in order to negate the generation of an alarm tone therefrom. Handling of the tag control unit 13 poses little problem to employees because of its ease of use. Furthermore, since the dedicated tag control unit 13 alone is capable of negating the alarm generating function of tags 2, any tag can be negated reliably only when and where necessary.

As many apparently different embodiments of this invention may be made without departing from the spirit and scope thereof, it is to be understood that the invention is not limited to the specific embodiments thereof except as defined in the appended claims.

What is claimed is:

1. An alarm-equipped electronic article surveillance system comprising:

a signal transmitter device located close to the gates of access to an area of interest; and a tag for attachment to an article of merchandise under surveillance;

said signal transmitter device including a signal generator for generating a modulated signal by modulating a carrier frequency signal with a modulation signal having a frequency, a signal transmitter for transmitting said modulated signal, and a transmitting antenna;

said tag includes a receiving antenna, a signal receiver for selectively receiving said modulated signal, a frequency selector for selecting said modulation signal out of said modulated signal, an alarm generator operable for generating an output indicative of an alarm condition, and an alarm negator for negating the operation of said alarm generator in response to receiving a control signal having a frequency, wherein said frequency of said control signal is the same frequency as said frequency of said modulation signal.

2. An alarm-equipped electronic article surveillance system according to claim 1, wherein said alarm negator comprises a control signal detecting tip and an AND circuit, said control signal detecting tip receiving said control signal having the same frequency as that of said modulation signal provided by a tag control unit, the output of said AND circuit being connected to said alarm generator, wherein said AND circuit acts to have the operation of said alarm generator negated if the control signal received by said control signal detecting tip is input to said AND circuit concurrently with the control signal received via said frequency selector by said control signal detecting tip.

3. An alarm-equipped electronic article surveillance system according to claim 2, wherein said tag control unit includes a signal generator and a signal output unit, said signal generator generating said control signal having the same frequency as that of said modulation signal, said signal output unit outputting said control signal.

4. An alarm-equipped electronic article surveillance system according to claim 3, wherein said control signal detecting tip is either a connector terminal or a connector element coupled to said signal output unit of said tag control unit.

5. An alarm-equipped electronic article surveillance system according to claim 2, wherein said control signal detecting tip is a light-receiving element for receiving an optical control signal emitted by said signal output unit of said tag control unit.

6. An alarm-equipped electronic article surveillance system according to claim 1, wherein said alarm generator operators to generate said output indicative of an alarm condition in response to said signal receiver selectively receiving said modulated signal and said frequency selector selecting said modulated signal out of said received modulated signal.

7. An alarm-equipped electronic article surveillance system according to claim 1, wherein said alarm negator comprises a control signal detecting tip for receiving said control signal.

8. An alarm-equipped electronic article surveillance system according to claim 7 wherein said control signal detecting tip includes a light receiving element for receiving said control signal, wherein said control signal is an optical control signal.

9. An alarm-equipped electronic article surveillance system according to claim 8 wherein said light receiving element includes a photo transistor.

10. An alarm-equipped electronic article surveillance system according to claim 8 wherein the optical control signal is generated by a light emitting diode of a tag control unit.

11. A tag for attaching to an article of merchandise in an alarm-equipped electronic article surveillance system, said tag comprising:

a receiving antenna;

a signal receiver for selectively receiving a first signal generated by a signal transmitter device;

an alarm generator operable for generating an output indicative of an alarm condition; and an alarm negator for negating the operation of said alarm generator, said alarm negator including a light receiving element for receiving an optical control signal, said alarm negator negates the operation of said alarm generator in response to receiving said optical control signal.

12. A tag according to claim 11 wherein said light receiving element includes a photo transistor.

13. A tag according to claim 11 wherein said optical control signal is generated by a light emitting diode of a tag control unit.

14. A tag according to claim 11, wherein the first signal has a first frequency, wherein the optical control signal has a second frequency, wherein the first frequency is different than the second frequency.

15. A tag according to claim 11, wherein the alarm generator operates to generate said output indicative of an alarm condition in response to said signal receiver selectively receiving said first signal.

16. A tag for attaching to an article of merchandise in an alarm-equipped electronic article surveillance system, said tag comprising:

a receiving antenna;

a signal receiver for selectively receiving a first signal generated by a signal transmitter device;

an alarm generator operable for generating an output indicative of an alarm condition; and an alarm negator for negating the operation of said alarm generator, said alarm negator includes a heat exchanger plate and a heat sensing element contacting the heat exchanger plate, wherein the alarm negator circuit negates the operation of said alarm generator in response to a heat source from a tag control unit contacting the heat exchanger plate to raise the temperature of the heat exchange plate as sensed by the heat sensing element.

17. A tag according to claim 16, wherein the alarm negator further includes a resistance detecting circuit for detecting the resistance of the heat sensing element, the resistance detecting circuit detects a change in resistance of the heat sensing element due to said heat source contacting said heat exchange plate.

18. A tag according to claim 16, wherein the alarm generator operates to generate said output indicative of an alarm condition in response to said signal receiver selectively receiving said first signal.

19. A tag for attaching to an article of merchandise in an alarm-equipped electronic article surveillance system, said tag comprising:

a receiving antenna;

a signal receiver for selectively receiving a modulated signal transmitted by a signal transmitter device, said modulated signal generated by modulating a carrier frequency signal with a modulation signal having a frequency;

a frequency selector for selecting said modulation signal out of said modulated signal;

an alarm generator operable for generating an output indicative of an alarm condition; and an alarm negator for negating the operation of said alarm generator in response to receiving a control signal having a frequency, wherein said frequency of said control signal is the same frequency as said frequency of said modulation signal.

20. A tag according to claim 19, wherein said alarm generator operates to generate said output indicative of an alarm condition in response to said signal receiver selectively receiving said modulated signal and said frequency selector selecting said modulation signal out of said received modulated signal.

21. A tag according to claim 19, wherein said negator comprises a control signal detecting tip for receiving said control signal.

22. A tag according to claim 21, wherein said control signal detecting tip includes a light receiving element for receiving said control signal, wherein said control signal is an optical control signal.

23. A tag according to claim 22, wherein said light receiving element includes a photo transistor.

* * * * *